US010813474B2

(12) United States Patent
Lim

(10) Patent No.: US 10,813,474 B2
(45) Date of Patent: Oct. 27, 2020

(54) MERCHANDISING SYSTEM

(71) Applicant: Kellogg Company, Battle Creek, MI (US)

(72) Inventor: Jane Yu Xin Lim, Singapore (SG)

(73) Assignee: KELLOGG COMPANY, Battle Creek, MI (US)

( * ) Notice: Subject to any disclaimer, the term of this patent is extended or adjusted under 35 U.S.C. 154(b) by 0 days.

(21) Appl. No.: 16/275,000

(22) Filed: Feb. 13, 2019

(65) Prior Publication Data

US 2019/0246814 A1 Aug. 15, 2019

Related U.S. Application Data

(60) Provisional application No. 62/630,414, filed on Feb. 14, 2018.

(51) Int. Cl.

| | |
|---|---|
| ***A47F 1/12*** | (2006.01) |
| ***A47F 5/00*** | (2006.01) |
| ***A47F 7/28*** | (2006.01) |

(52) U.S. Cl.

CPC ..... *A47F 1/126* (2013.01); *A47F 5/0025* (2013.01); *A47F 7/28* (2013.01)

(58) Field of Classification Search

CPC ..... A47F 1/126; A47F 5/0025; A47F 7/28; A47F 1/04; A47F 1/06; A47F 1/08;

(Continued)

(56) References Cited

U.S. PATENT DOCUMENTS 2,013,284 A * 9/1935 Michaud ..... A47F 1/12 193/35 R
2,948,624 A * 8/1960 Watson ..... B65D 5/32 220/8

(Continued)

FOREIGN PATENT DOCUMENTS

| | | |
|---|---|---|
| EP | 0928147 | 5/2003 |
| WO | 03/101258 | 12/2003 |

(Continued)

OTHER PUBLICATIONS

Display Technologies Shelf Management: https://display-technologies.com/pages/shelf-management.

(Continued)

*Primary Examiner* — Ko H Chan
(74) *Attorney, Agent, or Firm* — Honigman LLP; Kathryn D. Doyle, Esq.; Jonathan P. O'Brien

(57) ABSTRACT

A system for displaying merchandise includes a first tray member including a passage extending from a first end of the first tray member to a second end of the first tray member. The passage includes a support bed extending parallel to a longitudinal axis of the passage, and a ramp extending from the support bed to the second end at an oblique angle. The system further includes a second tray member including the passage. The second tray member is received by the first end of the first tray member, and is operable between a first position and a second position. In the first position, the passage has a first length and in the second position the passage has a second length. The system further includes a pusher disposed within the passage and operable between a first position adjacent the ramp, and a second position spaced apart from the ramp.

18 Claims, 5 Drawing Sheets

(58) Field of Classification Search
CPC .. A47F 1/087; A47F 1/12; A47F 1/125; A47F 5/005; A47F 7/17
See application file for complete search history.

(56) References Cited

U.S. PATENT DOCUMENTS

| | | | | |
|---|---|---|---|---|
| 3,134,499 | A * | 5/1964 | Johnson | B65D 5/0005 220/8 |
| 4,478,337 | A | 10/1984 | Flum | |
| 4,519,508 | A | 5/1985 | Gullett | |
| 5,050,748 | A * | 9/1991 | Taub | A47F 5/0043 211/126.1 |
| 5,111,942 | A * | 5/1992 | Bernardin | A47F 1/126 211/59.3 |
| 5,240,126 | A * | 8/1993 | Foster | A47F 1/126 211/175 |
| 5,542,552 | A * | 8/1996 | Yablans | A47F 1/126 211/43 |
| 5,645,176 | A | 7/1997 | Jay | |
| 5,695,076 | A | 12/1997 | Jay | |
| 5,695,077 | A | 12/1997 | Jay | |
| 5,806,690 | A * | 9/1998 | Johnson | A47F 1/126 211/175 |
| 6,347,710 | B1 * | 2/2002 | Ryan, Jr. | B07C 1/025 209/706 |
| 6,536,609 | B2 * | 3/2003 | Lake | A47F 1/126 211/59.3 |
| 6,637,604 | B1 | 10/2003 | Jay | |
| 6,679,033 | B2 | 1/2004 | Hart et al. | |
| 6,874,646 | B2 | 4/2005 | Jay | |
| 6,918,736 | B2 | 7/2005 | Hart et al. | |
| 6,955,269 | B2 | 10/2005 | Menz | |
| 6,957,941 | B2 | 10/2005 | Hart et al. | |
| 6,962,260 | B2 | 11/2005 | Jay | |
| 7,028,450 | B2 | 4/2006 | Hart et al. | |
| 7,080,969 | B2 | 7/2006 | Hart et al. | |
| 7,104,026 | B2 | 9/2006 | Welborn et al. | |
| 7,182,209 | B2 | 2/2007 | Squitieri | |
| 7,347,335 | B2 * | 3/2008 | Rankin, VI | A47F 1/126 211/59.3 |
| 7,462,012 | B2 | 12/2008 | Hart et al. | |
| 7,665,618 | B2 * | 2/2010 | Jay | A47F 1/12 211/59.2 |
| 9,107,516 | B2 | 8/2015 | Pichel | |
| 9,215,938 | B2 | 12/2015 | Neumann et al. | |
| 9,380,889 | B2 | 7/2016 | Howard | |
| 9,392,882 | B2 | 7/2016 | Pichel | |
| 9,526,356 | B2 | 12/2016 | Pichel et al. | |
| 9,615,675 | B2 | 4/2017 | Camello et al. | |
| 9,622,594 | B2 | 4/2017 | Gommermann et al. | |
| 9,713,395 | B2 | 7/2017 | Pichel | |
| 9,723,933 | B2 | 8/2017 | Howard et al. | |
| 9,968,206 | B2 * | 5/2018 | Hardy | A47F 1/126 |
| 2003/0185937 | A1 * | 10/2003 | Garwood | A22B 5/0029 426/35 |
| 2010/0258471 | A1 * | 10/2010 | Enriquez | B65D 1/34 206/557 |
| 2011/0094980 | A1 * | 4/2011 | Cousin | A47F 5/005 211/59.2 |
| 2011/0189355 | A1 * | 8/2011 | Field | B65D 1/34 426/129 |
| 2014/0367544 | A1 * | 12/2014 | Graves | A47F 3/14 248/346.02 |
| 2015/0096948 | A1 * | 4/2015 | Mason | A47F 1/12 211/59.2 |
| 2015/0257546 | A1 | 9/2015 | Pichel | |
| 2016/0106234 | A1 | 4/2016 | Pichel et al. | |
| 2016/0206117 | A1 | 7/2016 | Howard | |
| 2016/0278540 | A1 | 9/2016 | Gommermann et al. | |
| 2016/0324334 | A1 | 11/2016 | Pichel | |

FOREIGN PATENT DOCUMENTS

| | | |
|---|---|---|
| WO | 2009152246 | 12/2009 |
| WO | 2014200759 | 12/2014 |
| WO | 2015038846 | 3/2015 |
| WO | 2016154616 | 9/2016 |

OTHER PUBLICATIONS

PCT/US2019/017866 International Search Report dated Mar. 29, 2019.

* cited by examiner

MERCHANDISING SYSTEM

CROSS REFERENCE TO RELATED APPLICATIONS

This patent application claims priority under 35 U.S.C. § 119(e) to U.S. Provisional Application 62/630,414, filed on Feb. 14, 2018. The disclosure of this prior application is considered part of the disclosure of this application and is hereby incorporated by reference in its entirety.

TECHNICAL FIELD

This disclosure relates to retail cases that display and dispense products and merchandise.

BACKGROUND

In retail environments it is desirable to display merchandise in such a manner that the merchandise is prominently presented to potential purchasers. In many retail establishments, merchandise may be stocked on a horizontal shelf, in a back-to-front manner. Accordingly, when customers wish to purchase one or more items of the merchandise, the items at the front of the shelf will typically be selected first. Thus, as the supply of the merchandise on the shelf decreases, the foremost item of the remaining merchandise becomes incrementally farther away from the front of the shelf.

In some cases, gravity-fed displays have been implemented to ensure that merchandise is always presented at the front of the shelf. However, gravity-fed displays are limited in their capacities, as providing additional merchandise capacity requires additional height to facilitate a continuous gravity feed. Accordingly, gravity-fed displays may not be suitable in situations where shelf heights are limited.

SUMMARY

The details of one or more implementations of the disclosure are set forth in the accompanying drawings and the description below. Other aspects, features, and advantages will be apparent from the description and drawings, and from the claims.

In some implementations, a system for displaying merchandise is provided. The system includes a first tray member including a passage extending from a first end of the first tray member to a second end of the first tray member. The passage defines a longitudinal axis of the first tray member. The first tray member includes a support bed extending parallel to the longitudinal axis, and a ramp extending from the support bed to the first end of the first tray member at an oblique angle. The system further includes a second tray member including the passage. The second tray member is received by the second end of the first tray member, and is operable between a first configuration and a second configuration. In the first configuration, the passage has a first length and in the second configuration the passage has a second length. The system further includes a pusher disposed within the passage and operable between a first position adjacent the ramp, and a second position spaced apart from the ramp.

The system may include one or more optional features. In some examples, a first side of the first tray member is slideably received by a second side of the second tray member.

In some implementations, the first tray member includes a first track formed on a first side of the passage, and the second tray member includes a first rail formed on the first side of the passage. The first rail is slideably received by the first track. Here, the first tray member may include a second track formed on a bottom of the passage, and the second tray member may include a second rail formed on the bottom of the passage. The second rail is received by the second track.

In some examples, the second tray member is configured to telescope from the first tray member.

In some implementations, the pusher includes a retractor having a first end attached to the pusher and a second end attached to the support bed.

Optionally, the first tray member includes a first coupler on a first side and a second coupler on an opposing second side. Here, the first coupler is configured to cooperate with the second coupler.

In some examples, the first tray member includes a detachable nose formed of a transparent material. The nose includes the ramp of the passage and a pair of fingers extending from the ramp at the first end of the first tray member. Optionally, the fingers are spaced apart from each other along the first end of the first tray member, and extend transverse to the ramp.

In some implementations, the pusher includes a concave pushing surface facing the first end of the first tray member.

In another aspect of the disclosure, a system for displaying merchandise is provided. The system includes a first tray member including a first side and a second side spaced apart from first side by a passage. The passage extends from a first end of the first tray member to a second end of the first tray member. The first tray member includes a support bed extending between the first side and the second side at a first end of the passage, and a ramp extending between the first side and the second side at a second end of the passage. The system further includes a second tray member having a third side and a fourth side spaced apart from the third side by the passage. The third side is slideably received by the first side of the first tray member and the fourth side is slideably received by the second side of the first tray member. The second tray member is operable between a first configuration, wherein the passage has a first length, and a second configuration, wherein the passage has a second length. The system further includes a pusher disposed within the passage and operable between a first position and a second position on the support bed. The first position is adjacent the ramp and the second position is spaced apart from the ramp.

The system may include one or more of the following optional features. In some examples, the ramp extends from the support bed at an oblique angle.

In other implementations, the pusher includes a spring having a first end attached to the pusher and a second end attached to the support bed.

Optionally, the first tray member includes a first track formed on a first side of the passage, and the second tray member includes a first rail formed on the first side of the passage. Here, the first rail is slideably received by the first track. The first tray member may include a second track formed on a bottom of the passage, and the second tray member may include a second rail formed on the bottom of the passage. Here, the second rail is slideably received by the second track.

In some examples, the first tray member includes a first coupler on the first side and a second coupler on the second side. The first coupler is configured to receive the second coupler.

In some implementations, the first tray member includes a detachable nose formed of a transparent material and including the ramp. Here, the nose may include a pair of fingers extending from the ramp at the first end of the first tray member. Optionally, the fingers are spaced apart from each other along the first end of the first tray member.

In some examples, the pusher includes a concave pushing surface facing the first end of the first tray member.

DESCRIPTION OF DRAWINGS

Like reference symbols in the various drawings indicate like elements.

DETAILED DESCRIPTION

Figure 1:
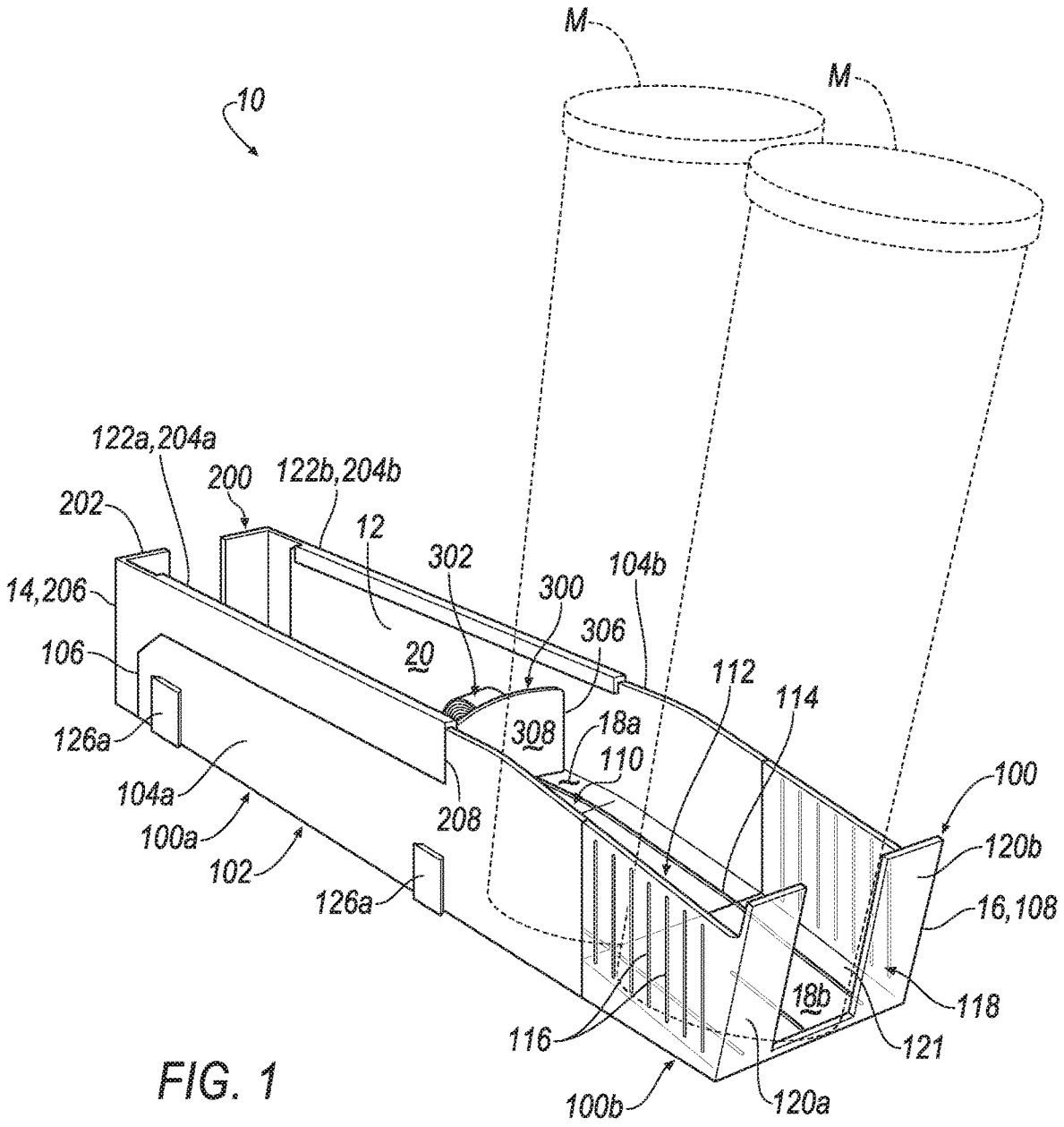
FIG. 1 is a perspective view of a tray of a merchandising system according to the principles of the instant disclosure.

Example embodiments will now be described more fully with reference to the accompanying drawings. Example embodiments are provided so that this disclosure will be thorough, and will fully convey the scope of those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 5:
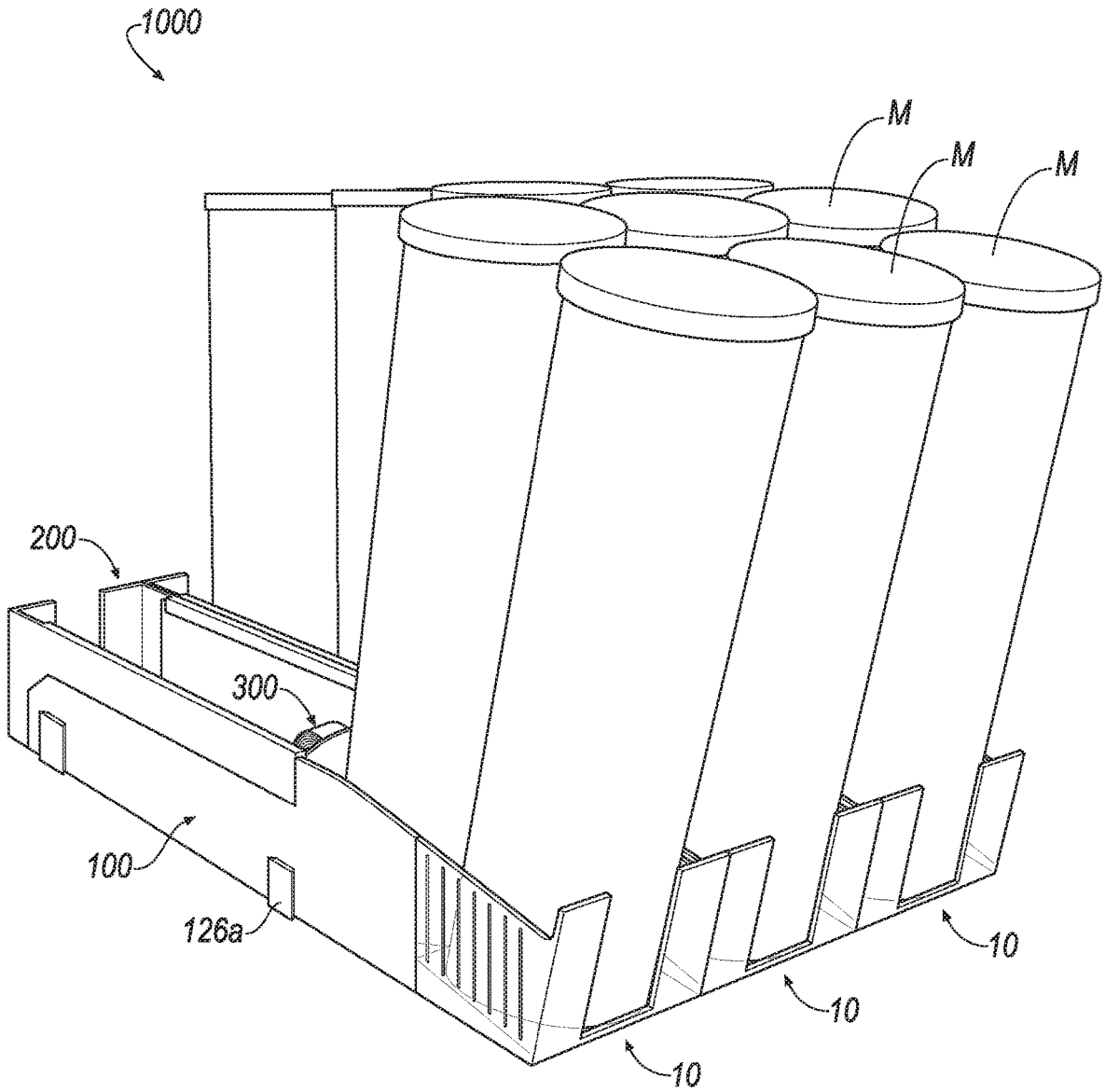
FIG. 5 is a perspective view of a merchandising system according to the principles of the instant disclosure, including a plurality of the trays of FIG. 1.

Referring initially to FIG. 5, a system 1000 for displaying merchandise M includes one or more telescoping trays 10 configured to continuously present a merchandise item M at the forefront of a horizontal store shelf. Each tray 10 includes a first tray member 100 and a second tray member 200 cooperating to define a passage 12 extending from a first end 14 of the tray 10 to a second end 16 of the tray 10 along a longitudinal axis $A_T$. As shown, the longitudinal axis $A_T$ corresponds to a direction of travel of the merchandise M along the passage 12. The tray 10 further includes a pusher 300 disposed within the passage 12. The pusher 300 is moveable between the first end 14 and the second end 16, and is configured to bias the merchandise M towards the second end 16.

With reference to FIGS. 1-4, in some examples the first tray member 100 may be include a first part forming a main body 100*a* and a second part forming a nose 100*b*. The main body 100*a* may be formed of an opaque polymeric material, while the nose 100*b* is formed of a transparent polymeric material. Accordingly, the merchandise M may be visible through the nose 100*b*. Alternatively, the first tray member 100 may be formed unitarily, such that entire first tray member 100 is substantially formed of a single part.

With reference to FIGS. 1-5, the first tray member 100 includes a base 102 and a pair of sidewalls 104*a*, 104*b* extending upwardly from opposing sides of the base 102. As shown, the base 102 and the sidewalls 104*a*, 104*b* extend from a first end 106 of the first tray member 100 to a second end 108 of the first tray member 100, such that the second end 108 of the first tray member 100 may define the second end 16 of the tray 10. Accordingly, the base 102 and the sidewalls 104*a*, 104*b* cooperate to define a first portion of the passage 12 extending along the first tray member 100. In some examples, the sidewalls 104*a*, 104*b* may extend transverse to the base 102 and parallel to each other. In some examples, the sidewalls 104*a*, 104*b* may extend orthogonally from the base 102. However, the sidewalls 104*a*, 104*b* may extend at other angles, and converge or diverge from each other in a direction extending away from the base 102.

In some examples, the base 102 of the first tray member 100 includes a support bed 110 and a ramp 112, which cooperate with the second tray member 200 to form a support surface 18 along the bottom of the passage 12. The support bed 110 extends from the first end 106 of the first tray member 100 along the longitudinal axis $A_T$ of the tray 10, and forms a first portion of the support surface 18, referred to hereafter as the support bed surface 18*a*. The support bed surface 18*a* extends substantially parallel to the longitudinal axis $A_T$, such that the support bed surface 18*a* is configured to be parallel to a shelf surface upon which the tray 10 is placed. For example, when the tray 10 is used on a horizontal store shelf, the support bed surface 18*a* will also be horizontal.

The ramp 112 extends from the support bed 110 to the second end 108 of the first tray member 100 and includes a second portion of the support surface 18, referred to hereafter as the ramp surface 18*b*. The ramp surface 18*b* extends from the support bed surface 18*a* at an oblique angle with respect to the longitudinal axis $A_T$ of the tray, such that the ramp surface 18*b* declines from the support bed surface 18*a* to the second end 108. The ramp 112 may include one or more ribs 114 extending between the support bed 110 and the second end 108 along the ramp surface 18*b*. The ribs 114 are configure to provide separation between the ramp surface 18*b* and a bottom surface of the merchandise M. Accordingly, the merchandise M may slide along the ribs 114 from the support bed 110 to the second end 108. The angle of the ramp surface 18*b* may be selected to provide a desirable slide speed of the merchandise M along the ramp 112.

As introduced above, the first tray member 100 may include the nose 100*b* removably attached to the main body 100*a* at the second end 108 of the first tray member 100. As shown, the main body 100*a* includes the support bed 110 and a first portion of the ramp 112, and the nose 100*b* includes a second portion of the ramp 112. The nose 100*b* further includes portions of the sidewalls 104*a*, 104*b* of the first tray member 100. The portions of the sidewalls 104*a*, 104*b* defined by the nose 100*b* may include a series of parallel corrugations 116 formed within the passage 12. As shown, the corrugations 116 extend along a direction transverse to the longitudinal axis $A_T$, and are configured to engage a lower portion of the merchandise M to secure the merchandise M within the nose 100*b*.

In the illustrated example, the second end 108 of the first tray member 100 includes a fence 118 extending upwardly from the ramp 112 between the sidewalls 104. As shown, the fence 118 extends transverse to the ramp surface 18*b*. Particularly, the fence 118 may extend orthogonally to the ramp surface 18*b*.

The fence 118 includes a pair of fingers 120*a*, 120*b* disposed on opposing sides of the passage 12 and spaced apart by an opening 121. Put another way, a first one of the fingers 120*a* extends inwardly from a first one of the sidewalls 104*a* to a first edge, and a second one of the fingers 120*b* extends inwardly from a second one of the sidewalls 104*b* to a second edge opposing and spaced apart from the first edge of the first finger 120*a*. A width of the opening 121 is defined by the opposing edges of the fingers 120*a*, 120*b*, and is configured to receive a portion of the merchandise M therein. Accordingly, noses 100*b* having different sized openings may be interchangeable with each other, such that different merchandise M can be presented using the same tray 10.

With continued reference to the figures, the first tray member 100 includes a plurality of tracks 122*a*-122*d* configured to cooperate with the second tray member 200 to facilitate telescoping of the second tray member 200 with respect to the first tray member 100 along the longitudinal axis $A_T$. For example, as shown in FIGS. 1 and 3B, the first tray member 100 includes first and second sidewall tracks 122*a*, 122*b* respectively formed on each of the sidewalls 104*a*, 104*b*. In the illustrated embodiment, the sidewall tracks 122*a*, 122*b* are formed along upper, distal edges of the sidewalls 104, opposite the base 102. Additionally or alternatively, the sidewalls 104 may include tracks formed intermediate the base 102 the distal edges of the sidewalls 104.

Figure 3A:
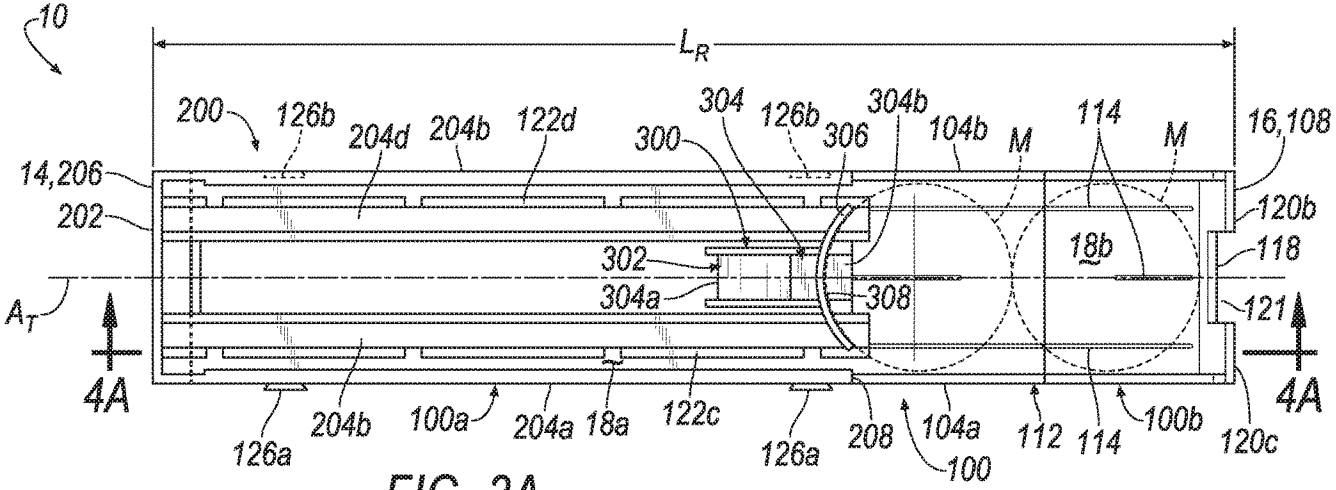
FIG. 3A is a plan view of the tray of FIG. 1, shown in the retracted configuration.
Figure 3B:
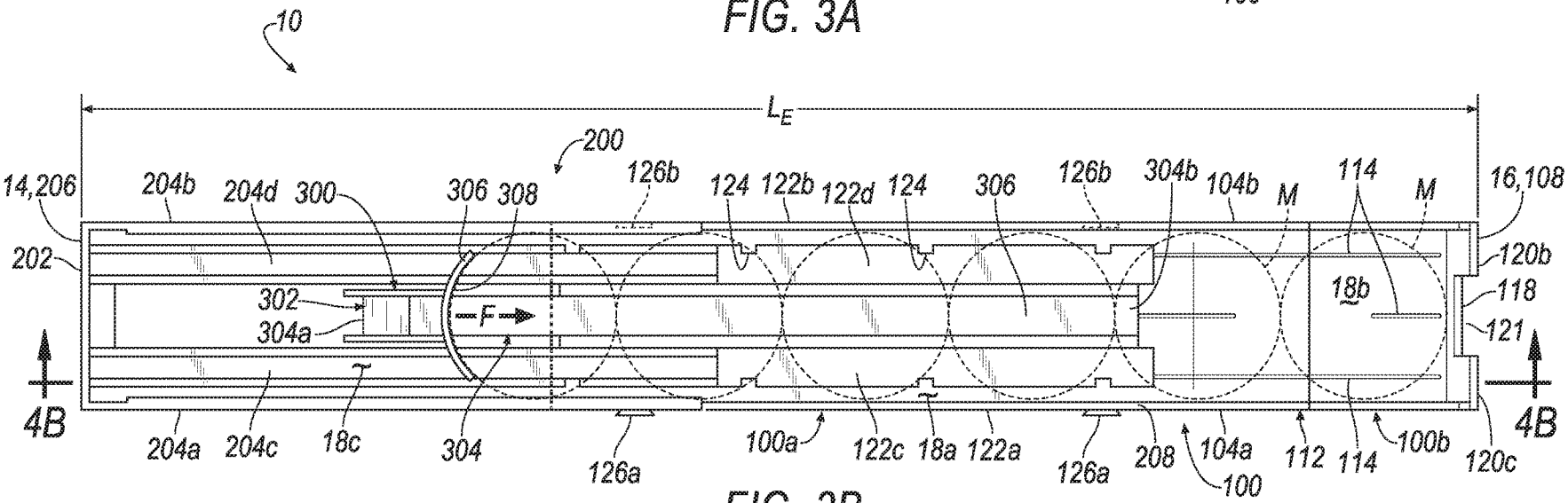
FIG. 3B is a plan view of the tray of FIG. 1, shown in the extended configuration.

As shown in FIGS. 3A and 3B, the first tray member 100 may further include one or more base tracks 122*c*, 122*d* extending longitudinally along the base 102. In the illustrated example, the base tracks 122*c*, 122*d* are formed within the support bed 110 of the base 102, and extend from the first end 106 of the first tray member 100 to the an intermediate portion of the support bed 110, adjacent the ramp 112. The base tracks 122*c*, 122*d* may be recessed from the support bed surface 18*a*, and include one or more retention tabs 124 configured to maintain engagement between the base tracks 122*c*, 122*d* and the second tray member 200, as discussed below.

As shown, the first tray member 100 includes one or more couplers 126*a*, 126*b* configured to engage a corresponding one or more couplers 126*a*, 126*b* of an adjacent tray 10, such that a series of trays 10 can be secured to each other along a shelf, as shown in FIG. 5. For example, as shown in FIG. 3B, a first coupler 126*a* may be formed on the base 102 and/or the first sidewall 104*a* on a first side of the first tray member 100, and a second coupler 126*b* configured to cooperate with the first coupler 126*a* may be formed on the base 102 and/or the second sidewall 104*b* on an opposing second side of the first tray member 100. Accordingly, the first coupler 126*a* of a first one of the trays 10 can be engaged with the second coupler 126*b* of a second one of the trays 10 to secure the trays 10 together along adjacent sidewalls 104*a*, 104*b*. In the illustrated example, the first coupler 126*a* is a rail extending vertically along the base 102 and the second coupler 126*b* is a slot extending vertically along the base 102, such that adjacent trays 10 can be secured to each other by dropping the second coupler 126*b* of one of the trays 10 onto the first coupler 126*a* of another one of the trays 10.

With continued reference to the figures, the second tray member 200 includes a rear wall 202 and a plurality of rails 204*a*-204*d* extending from the rear wall 202. More particularly, the rear wall 202 defines a first end 206 of the second tray member 200. The rails 204*a*-204*d* extend along the longitudinal axis $A_T$ from the rear wall 202 to a second end 208 of the second tray member 200. As shown, the first end 206 of the second tray member 200 defines the second end 16 of the tray 10.

The rails 204*a*-204*d* of the second tray member 200 cooperate with the tracks 122*a*-122*d* of the first tray member 100, such that each one of the rails 204*a*-204*d* is received by a respective one of the tracks 122*a*-122*d*. For example, the second tray member 200 includes a first pair of side rails 204*a*, 204*b* protruding from an upper portion of the rear wall 202. The side rails 204*a*, 204*b* define opposing sides 20 of the passage 12 through the second tray member 200. The side rails 204*a*, 204*b* are slideably received by the sidewall tracks 122*a*, 122*b* of the first tray member 100, and cooperate with the sidewall tracks 122*a* to define telescoping sides 20 of the passage 12.

The second tray member 200 further includes a pair of base rails 204*c*, 204*d* extending from a lower portion of the rear wall 202. The base rails 204*c*, 204*d* are slideably received by the base tracks 122*c*, 122*d* of the first tray portion 100, and may be retained within the base tracks 122*c*, 122*d* by the retention tabs 124. As shown, the base rails 204*c*, 204*d* cooperate with the support bed 110 of the first tray member 100 to define a third portion of the support surface 18, referred to hereafter as the telescoping surface 18*c*.

By providing a telescoping interface between the first tray member 100 and the second tray member 200, a length L of the passage 12—measured from the fence 118 to the rear wall 202—can be selectively adjusted. For example the tray 10 is configured to be selectively operable between a retracted configuration, where the passage 12 has a retracted length $L_R$, and an extended configuration, where the passage 12 has an extended length $L_E$ greater than the retracted length $L_R$. In some examples, the extended length $L_E$ of the passage is approximately 60% greater than the retracted length $L_R$. The tray 10 may also be configurable in configurations between the extended configuration and the retracted configuration.

In the retracted configuration, the rails 204*a*-204*d* of the second tray member 200 are fully received by the tracks 122*a*-122*d* of the first tray member 100, and the rear wall 202 of the second tray member 200 is adjacent the first end 106 of the first tray member 100. Accordingly, in the retracted configuration, the base 102 and the sidewalls 104*a*, 104*b* of the first tray member 100 and the rails 204*a*-204*d* of the second tray member 200 cooperate with each other to define the same portion of the passage 12.

In the extended configuration, the rails 204*a*-204*d* extend from the tracks 122*a*-122*d* at the first end 106 of the first tray member 100, and the rear wall 202 of the second tray member 200 is spaced apart from the first end 106. Accordingly, in the extended configuration, the base 102 and the sidewalls 104*a*, 104*b* of the first tray member 100 define a first portion of the passage 12 and the rails 204*a*-204*d* of the second tray member 200 define a second portion of the passage 12.

The pusher 300 is disposed within the passage 12 of the tray 10, and is operable along the passage 12 between a retracted first position, adjacent the ramp 112, and an extended second position, adjacent the first end 14 of the passage 12. Accordingly, the pusher 300 does not travel along the ramp 112. Further, because the first end 14 of the passage 12 is selectively positionable by extending and retracting the second tray member 200, the pusher 300 is configured to accommodate the configuration of the first end 14. For example, when the tray 10 is in the retracted configuration, the pusher 300 can travel along the support bed 110 to the rear wall 202. When the tray 10 is in the extended configuration, the pusher 300 may first travel along the support bed 110 to the first end 106 of the first tray member 100, and then travel along the rails 204 of the second tray member 200 to the rear wall 202. The passage 12 may be formed with one or more bearings or guides for maintaining alignment of the pusher 300, thereby preventing binding.

With reference to the FIGS. 1 and 3A-4B, the pusher 300 includes a retractor 302 configured to bias the pusher 300 towards the ramp 112. In the illustrated example, the retractor 302 includes a constant force spring 304 including a flat metal band 304 having a coiled end 304*a* attached to the pusher 300 and a free end 304*b* attached to the support bed 110 adjacent the ramp 112. The retractor 302 may include one or more idler pulleys for guiding the band 304 on and off of the coiled end 304*a* as the band 304 is unwound and rewound. The band 304 of the retractor 302 may extend along the support bed 110 and form a portion of the support surface 18. For example, the idler pulleys and the free end 304*b* may be arranged such that an upper surface of the band 304 is flush with the support bed surface 18*a* and/or the telescoping surface 18*c*. Accordingly, as the pusher 300 is extended, the band 304 is unwound along support bed surface 18*a* and the telescoping surface 18*c* to provide additional support to the merchandise M.

The pusher 300 further includes a biasing member 306 configured to engage the merchandise M. Particularly, the biasing member 306 is configured to bias the merchandise M towards the second end 16 of the passage. In the illustrated example, the biasing member 306 includes an arcuate front face 308 configured to receive a portion of the merchandise M therein. For example, where the merchandise M is a cylindrical can, the front face 308 may be concave and have a radius for receiving a portion of the can, thereby minimizing lateral movement of the merchandise M within the passage 12.

Figure 2A:
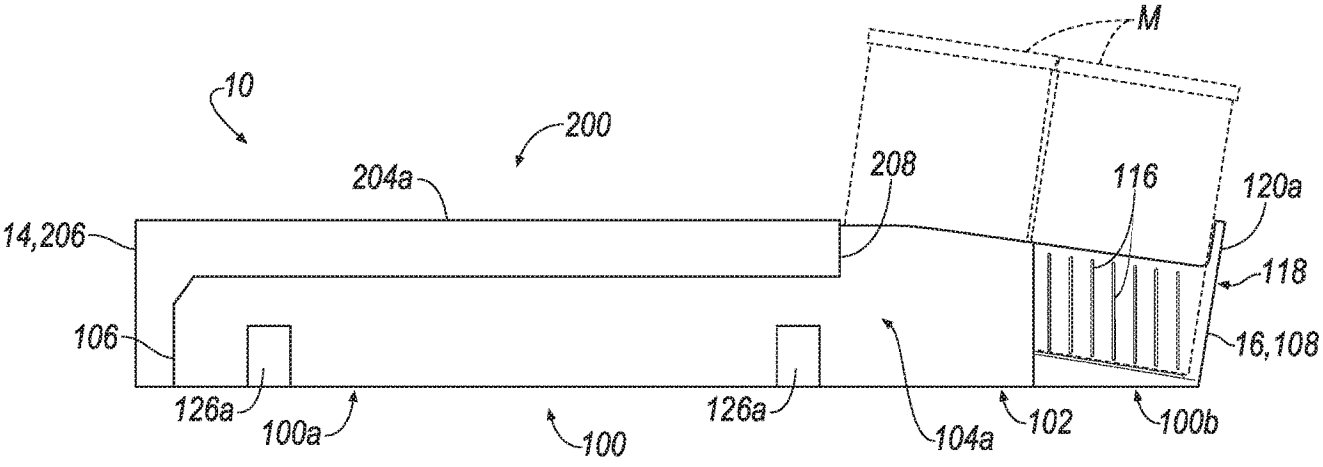
FIG. 2A is an elevation view of the tray of FIG. 1, shown in a retracted configuration.
Figure 2B:
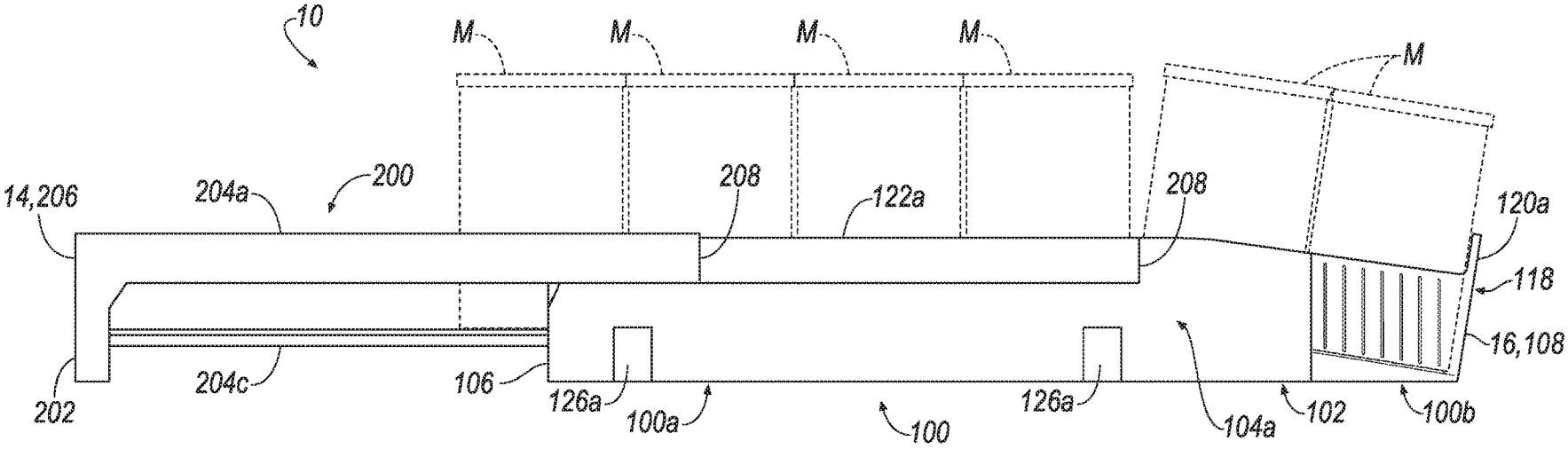
FIG. 2B is an elevation view of the tray of FIG. 1, shown in an extended configuration.
Figure 4A:
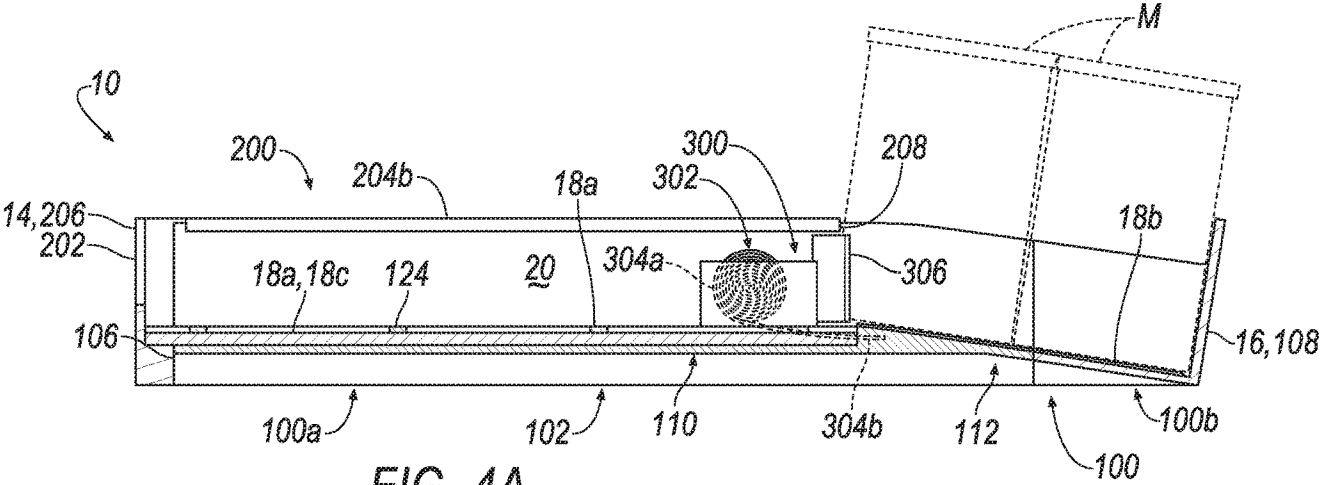
FIG. 4A is a cross-sectional view of the tray of FIG. 1, taken along section line 4A-4A in FIG. 3A.
Figure 4B:
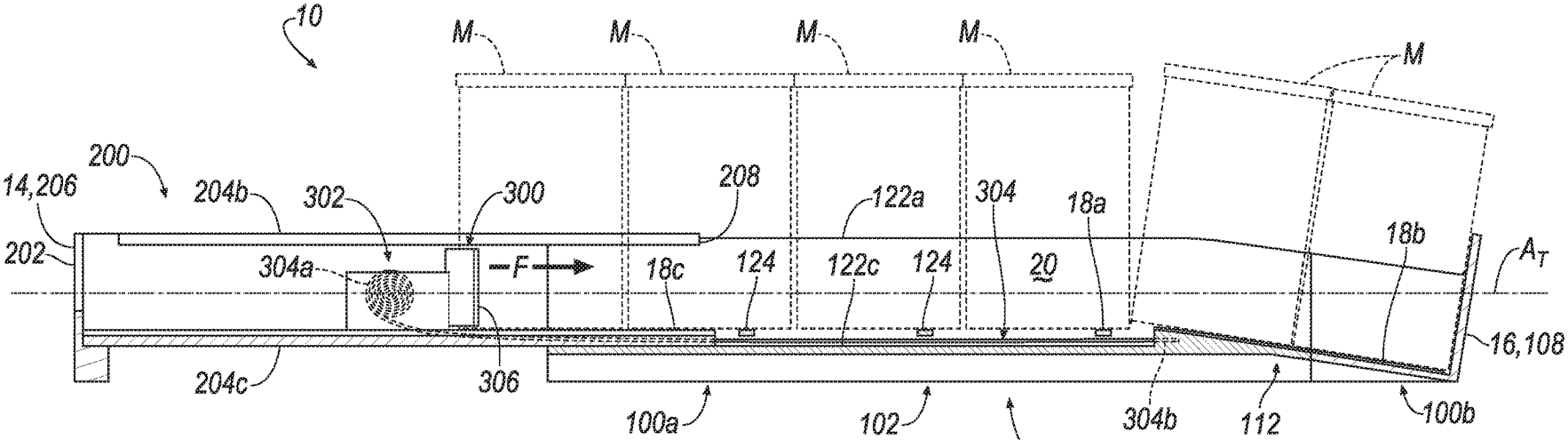
FIG. 4B is a cross-sectional view of the tray of FIG. 1, taken along section line 4B-4B in FIG. 3B.

In use, the tray 10 may be provided to a store shelf and configured to accommodate particular dimensions of the shelf. For example, the length L of the tray 10 may be selected based on a shelf depth. In instances where the shelf depth is relatively shallow, the tray 10 may be positioned in the retracted configuration and receive a first quantity of the merchandise M, as shown in FIGS. 2A, 3A, and 4A. Alternatively, where the shelf depth is greater, the tray 10 may be partially or fully extended to accommodate a greater quantity of the merchandise, as shown in FIGS. 2B, 3B, and 4B.

As shown in FIG. 5, a plurality of the trays 10 may be coupled together in a side-to-side arrangement to form the merchandising system 1000. As shown, the merchandising system 1000 may be configured to provide increased merchandise capacity, or to present several varieties of the merchandise M. Accordingly, in addition to providing adjustable length to accommodate shelves of various depths, the trays 10 may also accommodate shelves of various widths, as desired.

As the merchandise M is provided to the passage 12 of the tray 10, the pusher 300 is extended towards the first end 14 of the passage 12. As discussed above, the band 304 of the retractor 302 unwinds and provides a portion of the support surface 18 for the merchandise. As the band 304 unwinds, the coiled end 304*a* of the band 304 causes the pusher 300 to maintain a constant biasing force F against the merchandise M, as shown in FIGS. 3B and 4B. Accordingly, the pusher 300 biases the merchandise towards ramp 112. As items of the merchandise M are removed from the ramp 112, the pusher 300 advances the merchandise M towards the ramp 112 so that additional merchandise M can be gravity-fed to the fence 118 by the declined ramp surface 18*b*. By allowing the merchandise M to be gravity fed to the fence 118, as opposed to biasing the merchandise M against the fence 118, the merchandise M presented to a purchaser can be more easily removed from the tray 10.

The described example of the tray 10 advantageously provides a merchandising system 1000 that can be adapted to gravity feed merchandise M for a variety of shelf configurations. More specifically, the tray 10 can be adapted to gravity feed merchandise M on horizontal shelves of various depths. A number of implementations have been described. Nevertheless, it will be understood that various modifications may be made without departing from the spirit and scope of the disclosure. Accordingly, other implementations are within the scope of the following claims.

What is claimed is:

1. A system for displaying merchandise comprising:

a first tray member including:

a base;

a first side wall and a second side wall extending from the base, the second sidewall spaced apart from the first sidewall by a passage extending from a first end of the first tray member to a second end of the first tray member and defining a longitudinal axis, the passage including a support bed extending parallel to the longitudinal axis and a ramp extending from the support bed to the second end of the first tray member at an oblique angle;

a first coupler formed on the first sidewall adjacent to the base;

a second coupler formed on the second sidewall adjacent to the base and configured to engage a corresponding first coupler of a second system for displaying merchandise; and a series of corrugations disposed within the passage at the second end and extending in a direction transverse to the longitudinal axis, wherein the series of corrugations are arranged along a direction of the longitudinal axis;

a second tray member including the passage, the second tray member received by the first end of the first tray member and operable between a first configuration wherein the passage has a first length and a second configuration wherein the passage has a second length; and a pusher disposed within the passage and operable between a first position adjacent the ramp and a second position spaced apart from the ramp.

2. The system of claim 1, wherein a first side of the first tray member is slideably received by a second side of the second tray member.

3. The system of claim 1, wherein the first tray member includes a first track formed on a first side of the passage, and the second tray member includes a first rail formed on the first side of the passage, the first rail being slideably received by the first track.

4. The system of claim 3, wherein the first tray member includes a second track formed on a bottom of the passage, and the second tray member includes a second rail formed on the bottom of the passage, the second rail being slideably received by the second track.

5. The system of claim 1, wherein the second tray member is configured to telescope from the first tray member.

6. The system of claim 1, wherein the pusher includes a retractor having a first end attached to the pusher and a second end attached to the support bed.

7. The system of claim 1, wherein the first tray member includes a detachable nose formed of a transparent material, the nose including the ramp of the passage and a pair of fingers extending from the ramp at the second end of the first tray member.

8. The system of claim 7, wherein the fingers are spaced apart from each other along the second end of the first tray member, and extend transverse to the ramp.

9. The system of claim 1, wherein the pusher includes a concave pushing surface facing the first end of the first tray member.

10. A system for displaying merchandise comprising:

a first tray member including;

a base;

a first sidewall and a second sidewall extending from the base, the second sidewall spaced apart from the first sidewall by a passage extending from a first end of the first tray member to a second end of the first tray member and defining a longitudinal axis;

a first coupler formed on the first side wall adjacent to the base;

a second coupler formed on the second sidewall adjacent to the base and configured to engage a corresponding first coupler of a second system for displaying merchandise;

a support bed extending between the first side and the second side at a first end of the passage; and a ramp extending between the first side and the second side at a second end of the passage, the first side and the second side each including a series of parallel corrugations disposed at the second end and extending in a direction transverse to the ramp, wherein the series of parallel corrugations are arranged along a direction of the longitudinal axis;

a second tray member having a third side and a fourth side spaced apart from the third side by the passage, the third side slideably received by the first side of the first tray member and the fourth side slideably received by the second side of the first tray member, the second tray member operable between a first configuration wherein the passage has a first length and a second configuration wherein the passage has a second length; and a pusher disposed within the passage and operable between a first position on the support bed adjacent the ramp and a second position on the support bed spaced apart from the ramp.

11. The system of claim 10, wherein the ramp extends from the support bed at an oblique angle.

12. The system of claim 10, wherein the pusher includes a spring having a first end attached to the pusher and a second end attached to the support bed.

13. The system of claim 10, wherein the first tray member includes a first track formed on a first side of the passage, and the second tray member includes a first rail formed on the first side of the passage, the first rail being slideably received by the first track.

14. The system of claim 13, wherein the first tray member includes a second track formed on a bottom of the passage, and the second tray member includes a second rail formed on the bottom of the passage, the second rail being slideably received by the second track.

15. The system of claim 10, wherein the first tray member includes a detachable nose formed of a transparent material and including the ramp.

16. The system of claim 15, wherein the nose includes a pair of fingers extending transversely from the ramp at the second end of the first tray member.

17. The system of claim 16, wherein the fingers are spaced apart from each other along the second end of the first tray member.

18. The system of claim 10, wherein the pusher includes a concave pushing surface facing the second end of the first tray member.

* * * * *